US006866395B2

(12) United States Patent
Phipps et al.

(10) Patent No.: US 6,866,395 B2
(45) Date of Patent: Mar. 15, 2005

(54) PORTABLE LIGHT HAVING FLEXIBLY BRANCHED ARMS WITH LEDS

(75) Inventors: Martin Phipps, Portland, OR (US); Steven Cartier, Woodland, WA (US); Laurie M. O'Brien, Beaverton, OR (US); Kim Porter, Port, OR (US)

(73) Assignee: Empico, Ltd., Portland, OR (US)

( * ) Notice: Subject to any disclaimer, the term of this patent is extended or adjusted under 35 U.S.C. 154(b) by 47 days.

(21) Appl. No.: 10/630,538

(22) Filed: Jul. 29, 2003

(65) Prior Publication Data

US 2005/0024863 A1 Feb. 3, 2005

(51) Int. Cl.[7] ..... F21L 4/02
(52) U.S. Cl. ..... 362/198; 362/184; 362/197
(58) Field of Search ..... 362/198, 197, 362/184, 186

(56) References Cited

U.S. PATENT DOCUMENTS

| | | | | | |
|---|---|---|---|---|---|
| 5,154,483 | A | * | 10/1992 | Zeller | 362/198 |
| 5,944,407 | A | * | 8/1999 | Lynch et al. | 362/198 |
| 6,199,998 | B1 | * | 3/2001 | Hsiao | 362/119 |
| 6,502,957 | B1 | * | 1/2003 | Klaitman | 362/250 |
| 6,582,115 | B2 | * | 6/2003 | Huang | 362/565 |

* cited by examiner

*Primary Examiner*—Laura K. Tso
(74) *Attorney, Agent, or Firm*—ipsolon LLP

(57) ABSTRACT

A portable light has a weather resistant body and plural elongate, flexible branches, each having an LED lamp. The branches are independently bendable and hold their positions when bent so that light from the plural LEDs may be directed toward different objects. The portable light of the invention is suitable for outdoor use, which can be hand-held, hung overhead, or placed on a table or work surface.

17 Claims, 2 Drawing Sheets

PORTABLE LIGHT HAVING FLEXIBLY BRANCHED ARMS WITH LEDS

FIELD OF THE INVENTION

This invention relates to a portable light, and more particularly to a light having plural flexibly branched arms, each of which has a light emitting diode (LED) lamp. The light of the illustrated invention is especially suitable for outdoor use.

BACKGROUND AND SUMMARY

Portable lights such as flashlights are in frequent demand in outdoor activities. Many sizes of portable, hand-held lights are available, most of them designed to either focus a light beam or to diffuse light to illuminate a relatively greater area. Given the many different types of portable lights on the market, it is to be expected that many consumers own several different types of lights, often each different type best suited to a different purpose.

The present invention relates to a general-purpose light that includes a unique configuration and number of flexible arms or branches, each having an LED at one end and attached at the other end to the body of the light. Each of the branches may be positioned to direct the light in any desired direction relative to the other branches. The branches may be oriented to provide directional, focused lighting, and also diffuse lighting that covers a larger area with a wash of light. Because the position of the branches may be varied relative to one another, the direction that light is cast from any LED can be altered by redirecting one or more of the flexible branches. The light of the present invention thus allows a user to use a single light as a replacement for many different lights having different purposes.

The light illustrated in the present invention has a body that is preferably made of weather resistant material. Multiple flexible branches each ending in a bright, long-lasting LED are connected to the body. Each branch may be bent independent of the other branch so that the light from each branch may be directed onto a different object, or in a different direction from the other branches. A branch will remain in a bent configuration until the user changes its position. A branch may be re-bent or re-straightened as needed.

The light may be hung in a tent or other location for area lighting or for directional area lighting. It may be hand-held or placed in a standing position on a table or work surface. Further, the branches may be bent to create a mounting for the unit as well as direct lighting as desired. Holes integrated into the body near one end of the light comfortably accept a carabiner or other attachment device for additional attachment options.

For forward focus use, and for storage, the branches may be fitted into retaining receptors at the end of the body in such a manner that their beam is directed forward, providing a bright forward focused light.

BRIEF DESCRIPTION OF THE DRAWINGS

The invention will be better understood and its numerous objects and advantages will be more readily apparent by reference to the following detailed description of the invention when taken in conjunction with the following drawings.

DETAILED DESCRIPTION OF PREFERRED EMBODIMENTS

Figure 2:
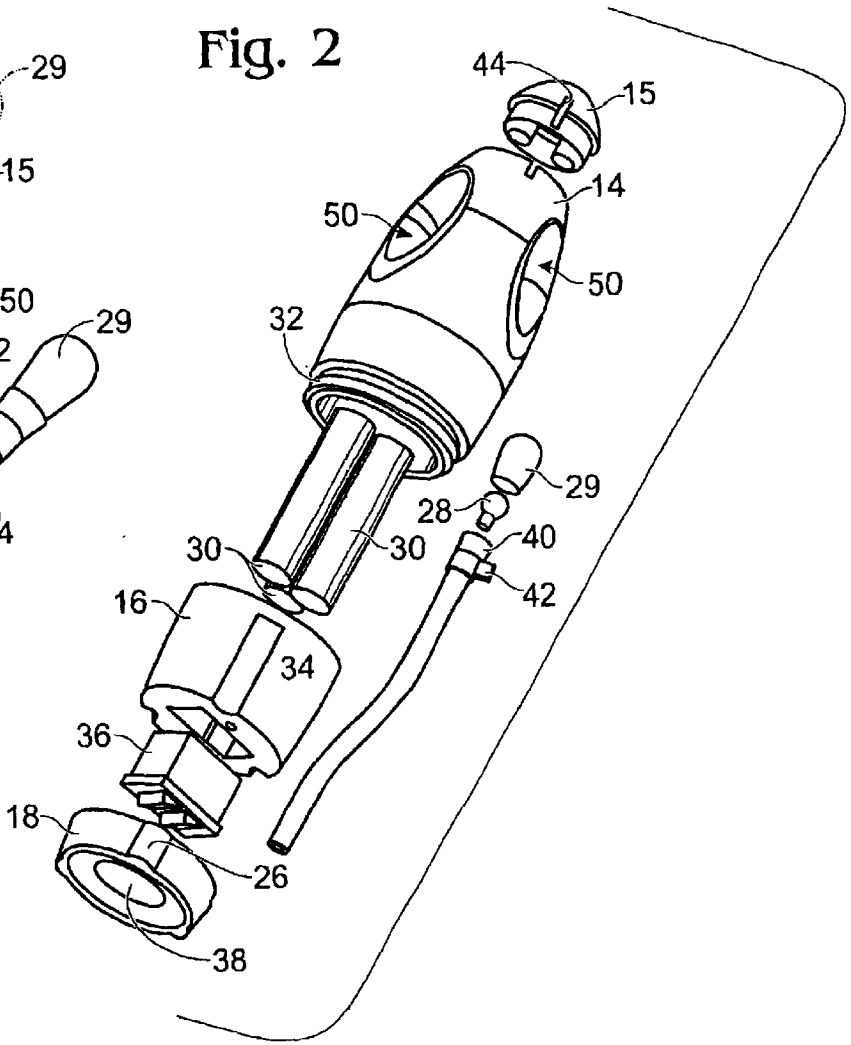
FIG. 2 is an exploded perspective view of the light illustrated in FIG. 1.
Figure 1:
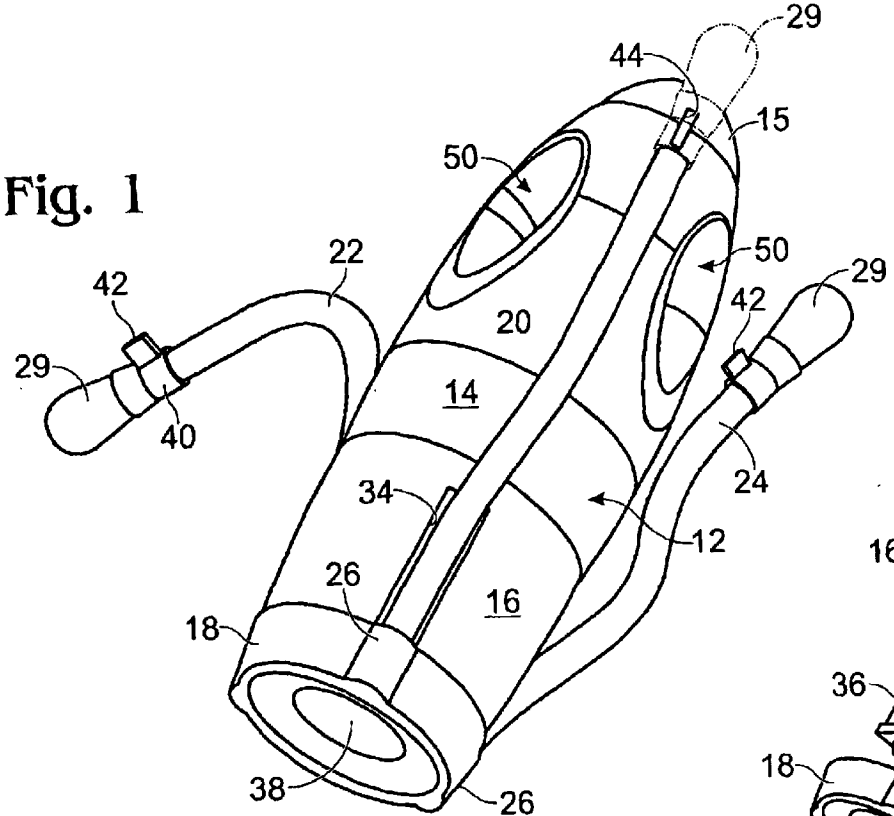
FIG. 1 is a perspective view of the light of the illustrated invention showing some of the flexible branches fixed into place on the body of the light in the forward focus position, and one of the flexible branches in a flexed position so that light emitted from that branch is cast in a different direction relative to the other branches.
Figure 3:
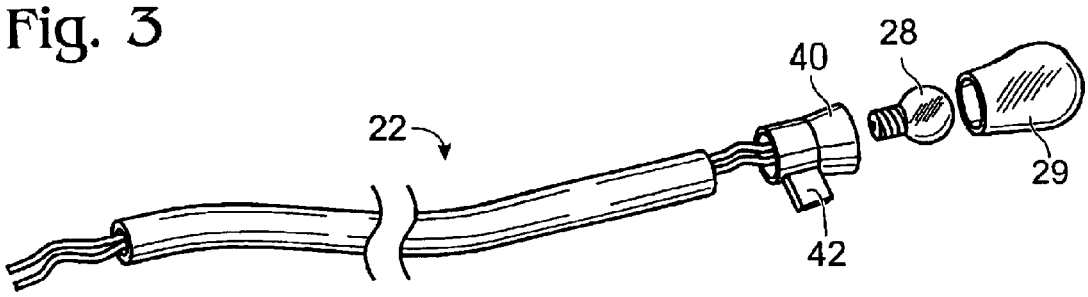
FIG. 3 is an isolated perspective view of a single flexible branch showing the LED, and the tab feature on the LED collar which may be fitted into the retaining slot in the body of the light when in the forward or storage position.

A preferred embodiment of the flexibly branched LED light 10 of the present invention is shown FIGS. 1 through 3. While the invention is illustrated and described with respect to its use as a compact light with three branches, it is to be understood that the invention is not limited to such use, and there may be more or less than the three flexible branches described herein. Moreover, although it is particularly well suited to outdoor use, the light of the present invention may just as well be used in any other location.

The light 10 is defined by a main body 12 that includes three primary body sections: an upper main body section 14, a lower main body section 16, and a flat base section 18. An end cap 15 is fitted onto the outer end of upper main body section 14. Three elongate flexible branches 20, 22 and 24 have a first end connected to cooperatively shaped receptacles 26 (two of which are shown in FIG. 1) formed around the periphery of base section 18. Although not shown, and as described below, each of the flexible branches 20, 22 and 24 includes internal wiring that connects an LED lamp 28 on the second or distal end of each branch to the electrical circuitry of the light 10. A lens 29 covers each LED 28.

The main body 12 of light 10 may be made of any appropriate material, but preferably is made of durable and weather-resistant plastic material such as ABS, although many different plastics, metal, and the like may be used. With reference to FIG. 2, the lower main body section 16 is generally hollow and is sized to contain a source of electrical power such as batteries 30. In the illustration of FIG. 2, three batteries 30 are illustrated, and for purposes of illustration it may be assumed that batteries 30 are of the standard size designation AAA. It will be understood, however, that the power source may be supplied by a variety of batteries, etc. Upper main body 14 is attached to the lower main body section 16 by any appropriate means such as male threads 32 formed on the portion of the upper main body that mates with the lower main body when the two are connected as in FIG. 1. Although not shown, when threads 32 are used, female threads are cooperatively formed in lower body section 16. The relative position between upper main body section 14 and lower main body section 16 is not important-that is, these two body sections are connected together without regard to the relative rotational positions of the two sections. However, the relative positions of lower body section 16 and base section 18 must be fixed because lower body section 16 includes elongate grooves 34 that are configured for receiving part of the branches 20, 22 and 24 when the branches are stored against the body 12. Accordingly, base section 18 is connected to lower body section 16 in a manner that allows the base section to be indexed relative to the lower body section, such as a snap-on or bayonet type mount.

With continuing reference to FIG. 2, a switch 36 that is electrically connected to open and close the electrical circuit that illuminates LEDs 29 is housed in a cooperatively shaped receiver opening 37 in lower main body section 14. A peripheral edge 39 formed on switch 36 is larger than the receiver opening 37 and thus prevents the switch from entering the receiver opening past the peripheral edge. Base section 18 includes an open central region 41 that allows a user to operate the switch 36. Moreover, the outermost peripheral rim portion 43 of base section 18 is generally flat so that the light 10 may be stood upright on base section 18, for example on a table or other work surface. The switch 36 may be of any appropriate type, such as a rocker switch or a push-button switch, and is preferably a dual position switch that allows for three different illumination states for the LEDs: when the switch is closed, a "low" illumination setting and a "high" illumination setting, and when the switch is open, the LEDs are not illuminated. The open central region 41 of base section 18 defines a recessed area relative to rim portion 43, and a flexible membrane 38 such as a thin urethane overmold that covers the central region 41 and thus the switch 36 allows a user to operate the switch. Membrane 38 provides a water-tight seal and protects the switch 36 from damage arising from exposure to moisture, dust, etc. Moreover, the membrane is inset into the lower portion of base section 18 so that the light 10 may be set upright on the base. It should be appreciated that switch 36 may just as well be located on other positions on the light.

The three flexible branches 20, 22 and 24 are connected to and arranged around the outer periphery of base section 18 at receptacles 26. As noted earlier, the wiring, which is not shown, extends through the interior of the branches. The outer portion of the branches 20, 22 and 24 is secured in receptacles 26 with an adhesive or another appropriate securement. Each of the branches extends upwardly along the sides of body 12 and such that a lower portion of each branch is configured for being received in grooves 34 as described above in the lower body section 16.

The flexible branches 20, 22 and 24 are preferably made of durable, flexible material such as deformable plastic coating or wrapped coaxial cable and the like, although many different materials may be used. Importantly, the branches may be bent at any variety of angles and will hold their position when bent. As well, the branches may be straightened and will hold their position. At the distal end of each branch is an LED 28 that is electrically connected to the circuitry in light 10. While use of an LED 28 is preferred, it is to be understood that the invention is not limited to LEDs and other illumination devices such as incandescent lamps may be used. A collar 40 is fitted to the distal end of each branch and LEDs 28 are housed in the collars 40. Collars 40 further define seats for the lenses 29. A retaining tab 42 extends from the collar 40 and may be frictionally fitted into receptor slot 44 formed in the upper main body section 14 and cap 15. When retaining tabs 42 are inserted into slots 44 the associated branches 20, 22 and 24 remain in the forward focus position in which the light from each of the LEDs is aimed forward in generally the same direction.

One flexible branch 22 is illustrated in isolation in FIG. 3. The elongate branch 22 is defined by a housing material that is readily flexible but which retains its deformed shape when bent to a curved position (as opposed to a linear branch position). The housing material is preferably plastic, and the wires that provide the electrical connection between the electrical circuitry and LED 28 is contained in the interior of the housing material.

As noted, each of the branches 20, 22 and 24 may be independently bent as shown in FIG. 1 with respect to branch 22 and when bent the branches retain their bent positions. This allows the user to direct the light wash from each of the three branches toward different targets. An optional flexible strengthening rod (not shown) may be incorporated into the branches to provide greater strength if desired.

Three openings 50 are formed through upper main body section 14 to define a means of attaching light 10 with a strap or carabiner or the like to another object, such as in a tent or hanging from a backpack. Moreover, as best seen in FIG. 1, the outer portion of upper main body section 14 is slightly recessed around the periphery of each opening 50 to provide an ergonomic thumb-rest.

Figure 4:
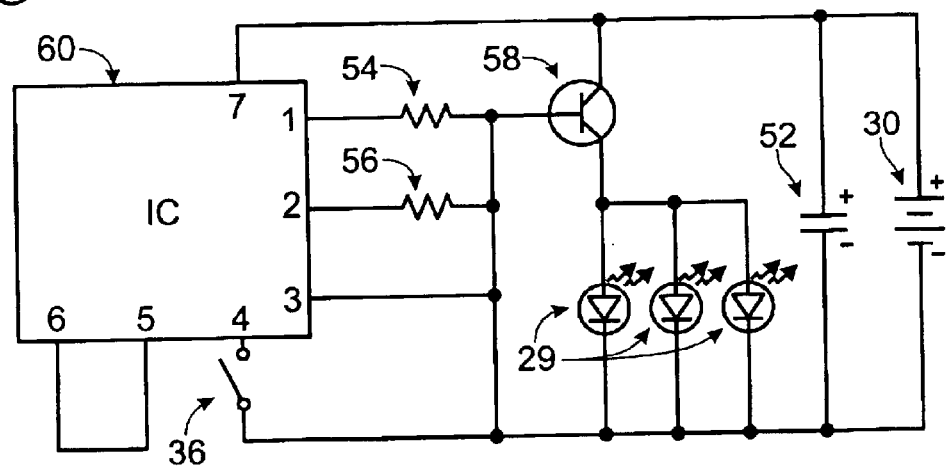
FIG. 4 is a schematic circuit diagram illustrating one possible electrical circuit that may be used with the illustrated invention.

The electrical components of the light 10 illustrated herein are described generally to provide context to the invention. It should be understood however that the electrical components described herein may be varied widely by those of ordinary skill in the art without departing from the scope of the invention. One exemplary circuit diagram that may be used with the light 10 described herein is shown in FIG. 4. For purposes of illustration, power supply 31 is preferably supplied by batteries 30, capacitor 52 is 100 $\mu$F, resister 54 is 100 KΩ and resister 56 is 6.8 KΩ, and transistor 58 is an 8550 transistor. All of these components are widely available. Control integrated circuit 60 may be configured according to desired electrical and functional parameters, and in the preferred embodiment, when combined with switch 36 which as noted is a dual position switch, allows the LEDs to be illuminated in a low illumination setting and a high illumination setting.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

We claim:

1. A light, comprising:

a body having a hollow core for holding a power source;

a plurality of elongate flexible branches, each attached at a first end to the body and each branch spaced apart from adjacent branches each flexible branch comprising a flexible material that may be deformed to a bent position and retains the bent position;

illumination means comprising an LED mounted to a second end of each flexible branch;

an electrical circuit sufficient to provide an electrical connection for illuminating the illumination means;

a switch operable to alternately close and open the electrical circuit, said switch configured for multiple illumination settings and wherein the body includes plural slots formed therein for receiving a tab proximate the second end of each flexible branch, and wherein when a tab is received in the slot the tab is retained in the slot.

2. The light according to claim 1 wherein each branch in the plurality is attached at the first end to a body base member and each branch in the plurality is spaced apart around a periphery of said body base member.

3. The light according to claim 2 wherein the switch is contained in a recess formed in the body base member.

4. The light according to claim 3 including a flexible membrane covering the switch and defining a fluid tight seal.

5. The light according to claim 1 wherein the switch is configured for a low and high illumination setting when the switch is in a closed position.

6. The light according to claim 2 wherein each branch in the plurality includes a lens at the second end thereof, and wherein each lens covers an LED.

7. The light according to claim 1 wherein the body further comprises openings formed therein.

8. A portable light comprising a body having a first end and an opposite end and a hollow core for holding a power source, a plurality of flexible, elongate arms attached at a first end thereof to the first end of the body and spaced around the periphery thereof, each of the elongate arms having a LED mounted to a second end of the arm and a lens covering the LED, an electrical circuit configured to provide an electrical connection for each LED, and a switch operable to alternately close and open the electrical circuit, wherein the switch is configured for operating the LEDs at multiple illumination settings, wherein the electrical circuit further comprises an integrated circuit and the switch comprises a dual position switch such that each LED may be illuminated in a low illumination setting and alternately in a high illumination setting.

9. The portable light according to claim 8 wherein each of the elongate arms further comprises flexible housing means for allowing the arms to be independently bent to bent positions to direct light from the LEDs toward different targets and wherein the flexible housing means allows the arms to retain their bent positions.

10. The portable light according to claim 9 wherein the flexible housing means comprises a flexible plastic material.

11. In a portable light having a hollow body for containing a battery, an illumination element, an electrical circuit configured for providing an electrical connection for illuminating the illumination element and a switch operable to alternately close and open the electrical circuit, the improvement comprising:

plural elongate branch members, each having an LED lamp on a distal end thereof and each branch connected to the body at a proximal end thereof, wherein each LED is electrically connected to the electrical circuit and wherein each branch member is independently bendable to a curved position such that the branch member retains the curved position, wherein the body includes a base portion and each of the branch members in the plurality is connected to the base member and space around the periphery thereof, and the base includes a recessed portion and the switch is accessible through the recessed portion.

12. The portable light according to claim 11 including a flexible membrane covering the switch and providing a fluid-tight seal around the switch.

13. The portable light according to claim 12 wherein the electrical circuit further comprises an integrated circuit and the switch comprises a dual position switch such that each LED lamp may be illuminated in a low illumination setting and alternately in a high illumination setting.

14. The portable light according to claim 13 wherein each of the elongate branches further comprises flexible housing means for allowing the branches to be independently bent to curved positions to direct light from the LEDs toward different targets and wherein the flexible housing means allows the branches to retain their curved positions.

15. A light, comprising:

a body;

a power source in the body;

a plurality of elongate flexible branches, each branch having a first end attached to the body such that the branches are spaced apart from other branches;

an LED mounted to a second end of each branch;

an electrical circuit sufficient to provide an electrical connection for illuminating the LEDs; and a switch operable to illuminate the LEDs in multiple illumination settings.

16. The light according to claim 15 wherein the switch is configured for a low and high illumination setting.

17. The light according to claim 15 wherein each flexible branch comprises a material that may be deformed to a bent position and retains the bent position.

* * * * *